United States Patent [19]

Uchida et al.

[11] 4,159,607

[45] Jul. 3, 1979

[54] WRAPPING PAPER SELECTING SYSTEM FOR USE IN COIN PACKAGING MACHINE

[75] Inventors: Isamu Uchida; Kenkichi Watanabe; Katusuke Furuya, all of Tokyo, Japan

[73] Assignee: Laurel Bank Machine Co., Ltd., Japan

[21] Appl. No.: 874,751

[22] Filed: Feb. 3, 1978

[51] Int. Cl.[2] ..... B65B 57/08

[52] U.S. Cl. ..... 53/64; 53/212

[58] Field of Search ..... 53/64, 212, 389; 242/58.6, 64; 133/1 A, 8 A, 8 R

[56] References Cited

U.S. PATENT DOCUMENTS

| | | | |
|---|---|---|---|
| Re. 27,987 | 4/1974 | Hatanaka et al. | 53/389 |
| 4,085,879 | 4/1978 | Nobuhiro | 53/212 |

*Primary Examiner*—John Sipos

*Attorney, Agent, or Firm*—Stevens, Davis, Miller & Mosher

[57] ABSTRACT

A wrapping paper selecting system for use in a coin packaging machine includes a coin selecting dial for selecting a desired type coin, a wrapping paper supporting table having a plurality of loading stations each for wrapping paper for a different type of coin, a wrapping paper feeding station and a drive for driving the supporting table so as to bring a desired one of the loading stations into the feeding station. A selected coin signal generator is associated with the coin selecting dial for producing a signal indicative of the type of coin which has been selected to be wrapped. A plurality of markings are exchangeably provided in the loading stations to identify the loading stations. A selected paper signal generator is provided in the feeding station for detecting the markings and producing a signal indicative of which loading station has been brought into the feeding station. A controller is provided for initiating operation of the drive when the coin selecting dial is set in a position to select a desired type of coin and stopping the operation of the drive when a signal from the selected paper signal generator coincides with a signal from the selected coin signal generator.

3 Claims, 4 Drawing Figures

WRAPPING PAPER SELECTING SYSTEM FOR USE IN COIN PACKAGING MACHINE

The present invention relates to a wrapping paper selecting system for use in a coin packaging machine.

There is known a wrapping paper selecting system for use in a coin packaging machine including a coin selecting dial for selecting a desired type of coin, a wrapping paper supporting table having a plurality of loading stations each for wrapping paper for a different type of coin, a wrapping paper feeding station and a drive for driving the supporting table so as to bring a desired one of the loading station into the feeding station. The known paper selecting system has the disadvantage that each of the loading stations is fixedly allotted to store only one type of wrapping paper and therefore one is not allowed to use the system in such a manner that when a desired one of the loading stations is brought into the feeding station and is feeding the desired type of wrapping paper he loads a spare roll of wrapping paper of the the type onto the other loading stations not in the operative position to the feeding station.

It is therefore an object of the present invention to provide a wrapping paper selecting system for use in a coin packaging machine wherein a spare roll of wrapping paper of any type can be loaded onto any of the loading stations.

According to the present invention, the above and other objects can be accomplished by a wrapping paper selecting. system for use in a coin packaging machine including a coin selecting dial for selecting a desired type of coin, a wrapping paper supporting table having a plurality of loading stations each for wrapping paper for a different type of coin, a wrapping paper feeding station and a drive for driving the supporting table so as to bring a desired one of the loading stations into the feeding station, said wrapping paper selecting system comprising a selected coin signal generating means associated with said coin selecting dial for producing a signal indicative of the type of coin which has been selected to be wrapped, a plurality of markings each provided in a corresponding one of said loading stations to identify the corresponding loading station, a selected paper signal generating means provided in said feeding station for detecting said markings and producing a signal indicative of which loading station has been brought into said feeding station, and a controlling means for initiating operation of said drive when said coin selecting dial is set in a position to select a desired type of coin and stopping the operation of said drive when a signal from said selected paper signal generating means coincides with a signal from said selected coin signal generating means, said markings being exchangeably mounted onto each of said loading stations.

The above and other objects and features of the present invention will become apparent from the following descriptions of preferred embodiments taking reference to the accompanying drawings, in which:

FIG. 1 is a side view of a wrapping paper selecting system embodying the present invention;

FIG. 2 partially diagrammatically shows the relationships among the coin selecting dial, paper loading stations and feeding station of the system of FIG. 1;

Figure 1:
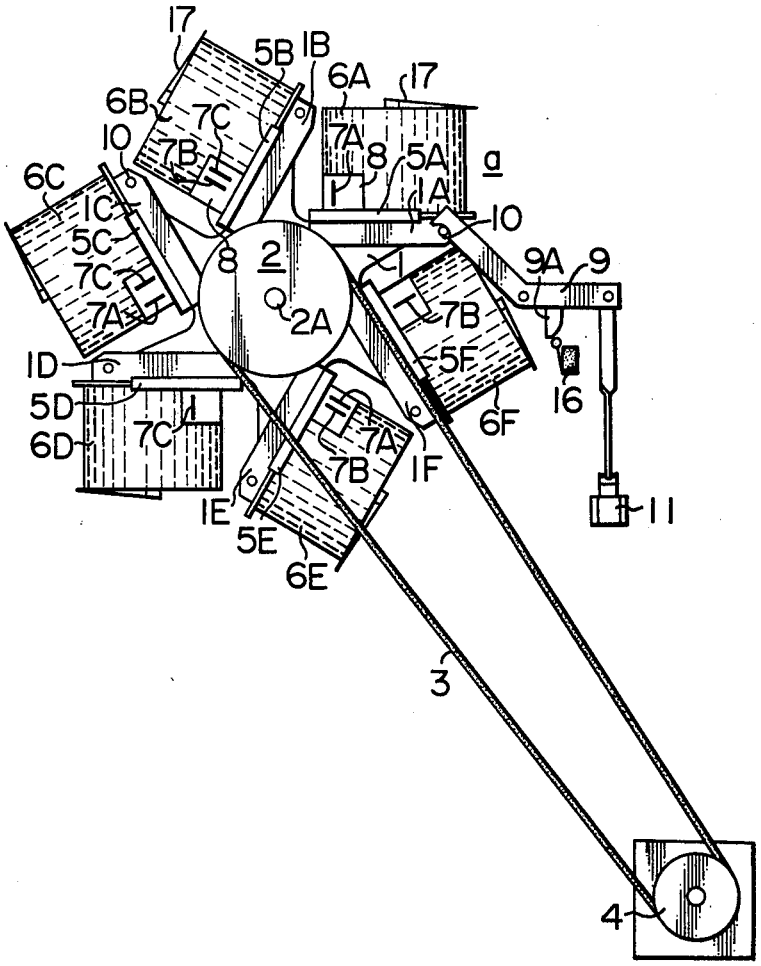

Referring to the drawings, particularly to FIG. 1, there is shown an example of wrapping paper selecting system according to the present invention. Six rolls 6A, 6B, 6C, 6D, 6E and 6F of different types of wrapping papers are carried on the loading stations 1A, 1B, 1C, 1D, 1E and 1F respectively of a wrapping paper supporting table 1 which is secured to a rotatable shaft 2A to be actuated by means of a motor 4 through a belt 3 and a pulley 2. The table 1 is provided at each loading station with a pin 10 which is adapted to be engaged by a hook member 9 under the action of a locking spring (not shown). For unlocking, a solenoid 11 is provided. The paper rolls 6A through 6F can be exchangeably loaded onto the respective loading station of the table 1 by means of paper loading plates 5A, 5B, 5C, 5D, 5E and 5F with retaining members 17 respectively. Each of the paper loading plates is provided with a switch actuating member 8. The switch actuating member 8 consists of an arrangement of one or more switch actuating elements 7A, 7B or 7C such as magnet pieces.

Figure 2:
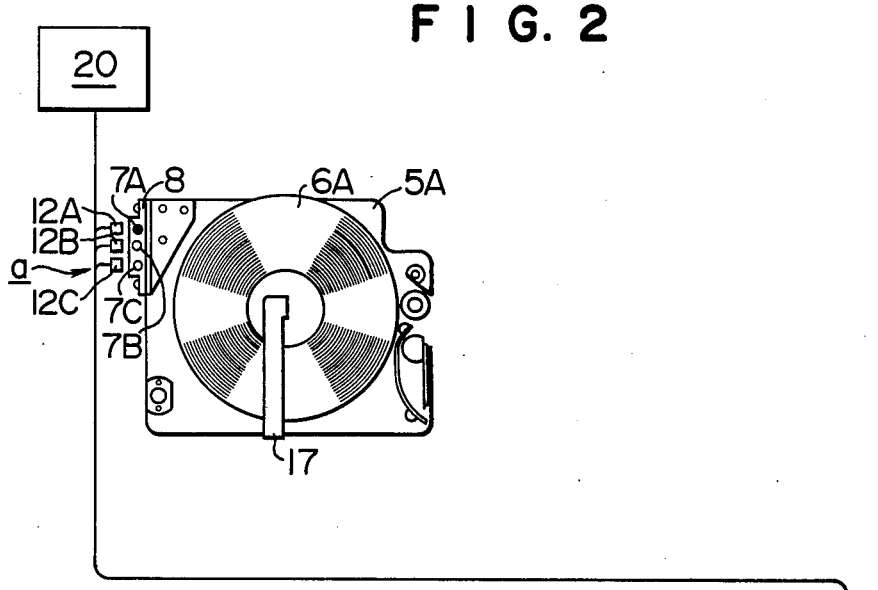

On the other hand, in a position as indicated by reference character a in FIGS. 1 and 2 and opposite to the loading station 1A in FIG. 1 a paper feeding station is provided as a stationary part of the system. As shown in FIG. 2, three two-way switches 12A, 12B and 12C are arranged in the paper feeding station so that the switch 12A, 12B and 12C can be opposite to the respective position of the switch actuating elements 7A, 7B and 7C when the paper loading plate is properly brought into the feeding station a.

Figure 3:
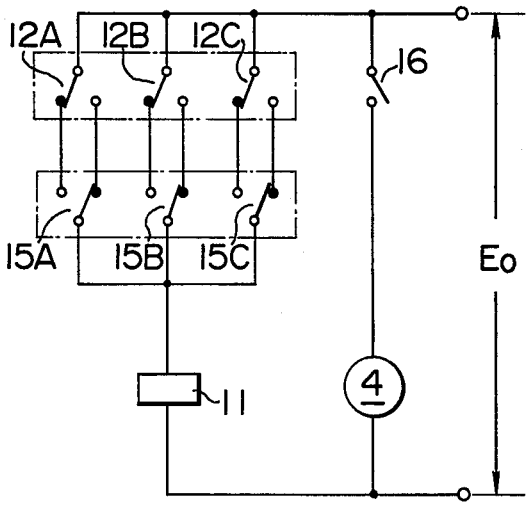
FIG. 3 is a circuit diagram of the control of the system of FIG. 1.

Moreover, the switches 12A, 12B and 12C are electrically connected to three two-way switches 15A, 15B and 15C which can be actuated by three corresponding cams 14A, 14B and 14C interlocked with a coin selecting dial 13 of the coin packaging machine, as shown in FIG. 2. In FIG. 2, a block designated by reference numeral 20 represents a control circuit which controls the operation of the paper selecting system in response to various combinations of actuations of the switches 12A, 12B and 12C and 15A, 15B and 15C. The control circuit 20 is shown in detail in FIG. 3.

Figure 4:
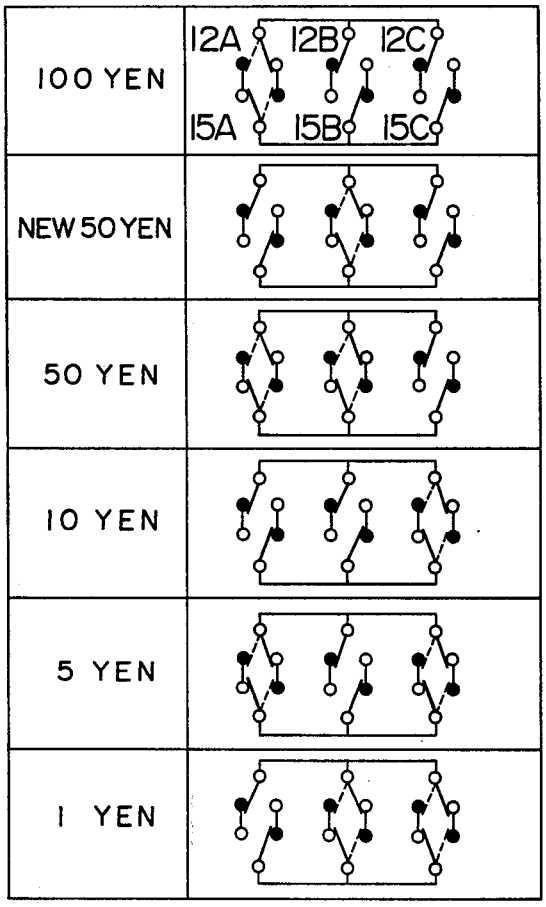
FIG. 4 shows various switch positions for different types of coins.

FIG. 4 shows the switch positions enabling selection of six positions by three switches 15A, 15B and 15C. Such positions are useful in Japan because there are six types of coins are currently in use. The positions of the switches 12A, 12B and 12C shown in FIG. 4 is based on the assumption that wrapping papers for 100 YEN, 1 YEN, 5 YEN, 10 YEN, 50 YEN and NEW 50 YEN coins are loaded onto the loading stations 1A, 1B, 1C, 1D, 1E and 1F respectively.

In operation for packaging coins, the dial 13 is rotated to select 100 YEN coins. Then, only the switch 15A is switched from the position shown in FIG. 3 to the position shown in solid line in the column of 100 YEN of FIG. 4. As apparent from FIG. 3, this causes the solenoid 11 to be energized through the switches 12A and 15A by a controlling power source $E_o$, thereby pulling the hook member 9 to be disengaged from the pin 10. Simultaneously, the switch actuating projection 9A of the hook member 9 actuates a switch 16 to be closed (see FIG. 1). As will be seen from FIG. 3, upon closing of the switch 16 the motor 4 is energized, thereby rotating the table 1. The rotation of the table 1 will continue until the loading station 1A onto which the plate 5A is mounted with a roll 6A of wrapping paper for 100 YEN coins loaded thereon reaches the feeding station a as shown in FIG. 1. When the loading station 1A is properly brought into the feeding station a, only the switch 12A is switched from the position shown in FIG. 3 to the position shown in solid line in the column of 100 YEN of FIG. 4 by the switch actuating element 7A of the member 8 attached to the plate 5A. Thus the circuit from the controlling power source $E_o$ to the solenoid 11 is broken and the unlocking solenoid 11 is de-energized so that the table 1 is locked by the hook 9 under the action of a locking spring (not shown) and simultaneously the switch 16 is opened to cause the motor 4 to be stopped. Then, the paper in the particular roll 6A is dispensed for use as well known in the art.

As will be seen from the operation of the embodiment described hereinbefore, in a paper selecting system according to the present invention it is possible to use the system in such a manner that a spare roll of wrapping paper of any type can be loaded onto any of the loading stations. For example, assuming that the loading station 1A having a roll 6A of wrapping paper for 100 YEN coins is in an operative position to the feeding station a as shown in FIG. 1 and is feeding the wrapping paper. In this condition, if it is desired to set a spare roll of wrapping paper of the same type in the machine, it may be loaded onto any of loading stations 1B, 1C, 1D, 1E and 1F other than the loading station 1A now in service. More specifically, if a spare roll of wrapping paper for 100 YEN coin is mounted onto a spare loading plate having the same arrangement of switch actuating element as the loading plate 5A and then loaded onto for example the loading station 1C in place of the roll 6C of wrapping paper for 5 YEN coins, the spare roll can be automatically brought into an operative position to the feeding station and feed wrapping paper for 100 YEN coins, in a similar way as described hereinbefore, when the present roll 6A becomes exhausted and the present plate 5A is removed from the loading station 1A. Thus, the time required for supplement of wrapping paper will be extremely reduced.

The invention has thus been shown and described with reference to a specific embodiment, however, it should be noted that the invention is in no way limited to the details of the illustrated arrangements but changes and modifications may be made without departing from the appended claims. For example, although in the embodiment described before the switch actuating elements 7A, 7B and 7C are attached to respective loading plates 5A, 5B, 5C, 5D, 5E and 5F, they may be exchangeably provided in the responsive loading stations 1A, 1B, 1C, 1D, 1E and 1F of the table 1.

We claim:

1. A wrapping paper selecting system for use in a coin packaging machine including a coin selecting dial for selecting a desired type of coin, a wrapping paper supporting table having a plurality of loading stations each for wrapping paper for a different type of coin, a wrapping paper feeding station and a drive for driving the supporting table so as to bring a desired one of the loading stations into the feeding station, said wrapping paper selecting system comprising a selected coin signal generating means associated with said coin selecting dial for producing a signal indicative of the type of coin which has been selected to be wrapped, a plurality of markings each provided in a corresponding one of said loading stations to identify the corresponding loading station, a selected paper signal generating means provided in said feeding station for detecting said markings and producing a signal indicative of which loading station has been brought into said feeding station, and a controlling means for initiating operation of said drive when said coin selecting dial is set in a position to select a desired type of coin and stopping the operation of said drive when a signal from said selected paper signal generating means coincides with a signal from said selected coin signal generating means, said markings having means to enable exchangeable mounting onto each of said loading stations thereby allowing the loading of a spare roll of wrapping paper of any type onto any of the loading stations.

2. A wrapping paper selecting system as claimed in claim 1 whereiin said selected coin signal generating means comprises a plurality of cams interlocked with said coin selecting dial and a plurality of first two-way switches adapted to be selectively actuated by said cams; said markings comprise different arrangements of switch actuating elements; said selected paper signal generating means comprises a plurality of second two-way switches adapted to be selectively actuated by said elements; and said controlling means comprises a controlling power source, a solenoid, a control switch adapted to be actuated when said solenoid is energized and an electrical connection wherein said first and second two-way switches and said solenoid are connected in series across said power source and said control switch and said drive are connected in series across said power source.

3. A wrapping paper selecting system as claimed in claim 2 wherein each of said loading stations includes a paper loading plate exchangeably mounted thereon and said switch actuating elements are attached to said plate.

* * * * *